United States Patent [19]

Ikeda

[11] Patent Number: 4,628,305

[45] Date of Patent: Dec. 9, 1986

[54] COLOR DISPLAY UNIT

[75] Inventor: Yoshiaki Ikeda, Hachioji, Japan

[73] Assignee: Fanuc Ltd, Hino, Japan

[21] Appl. No.: 536,877

[22] Filed: Sep. 29, 1983

[30] Foreign Application Priority Data

Sep. 29, 1982 [JP] Japan ..... 57-172459

[51] Int. Cl.[4] ..... G09G 1/00; G09G 1/28

[52] U.S. Cl. ..... 340/703; 340/721; 340/799; 340/729

[58] Field of Search ..... 340/701, 703, 721, 723, 340/724, 729, 798, 799

[56] References Cited

U.S. PATENT DOCUMENTS

| | | | |
|---|---|---|---|
| 4,016,544 | 4/1977 | Morita et al. | 340/703 |
| 4,156,237 | 5/1979 | Okada et al. | 340/729 |
| 4,217,577 | 8/1980 | Roe et al. | 340/703 |
| 4,439,760 | 3/1984 | Fleming | 340/703 |
| 4,447,809 | 5/1984 | Kodama et al. | 340/703 |
| 4,484,187 | 11/1984 | Brown et al. | 340/721 |
| 4,580,135 | 4/1986 | Kammer et al. | 340/703 |
| 4,595,917 | 6/1986 | McCallister et al. | 340/703 |

*Primary Examiner*—Gerald L. Brigance
*Attorney, Agent, or Firm*—Staas & Halsey

[57] ABSTRACT

A plurality of picture RAMs are synchronously accessed by a CRT controller, and the priority levels of the outputs from the picture RAMs are specified by priority specifying means. A priority circuit has as inputs the outputs of the picture RAMs and selects the inputs in accordance with the specified priority levels for output to a color display. The color display displays, on its CRT screen, graphic forms in colors determined by a combination of the picture RAMs. A feedback circuit feeds the output of the priority circuit back to the picture RAMs, and data update control means specifies which one of the picture RAMs is to be rewritten with the output of the feedback circuit. By hardware processing the stored content of a desired one of the picture RAMs is rewritten with the output of the priority circuit.

12 Claims, 20 Drawing Figures

FIG. 5

| SPECIFYING INFORMATION | | | | | | PRIORITY | | |
|---|---|---|---|---|---|---|---|---|
| RI | RO | GI | GO | BI | BO | RED | GREEN | BLUE |
| 0 | 0 | 0 | 0 | 0 | 0 | A | A | A |
| 0 | 0 | 0 | 0 | 1 | 1 | A | A | B |
| 0 | 0 | 1 | 1 | 0 | 0 | A | B | A |
| 1 | 1 | 0 | 0 | 0 | 0 | B | A | A |
| 0 | 0 | 0 | 1 | 1 | 1 | A | B | C |
| 0 | 0 | 1 | 1 | 0 | 1 | A | C | B |
| 0 | 1 | 0 | 0 | 1 | 1 | B | A | C |
| 1 | 0 | 1 | 1 | 0 | 0 | B | C | A |
| 1 | 1 | 0 | 0 | 1 | 0 | C | A | B |
| 1 | 1 | 1 | 0 | 0 | 0 | C | B | A |

COLOR DISPLAY UNIT

BACKGROUND OF THE INVENTION

The present invention relates to a color display unit and, more particularly, to improvement in or relating to system for specifying a color of each portion of a picture to be displayed.

With conventional color display units, in the case of putting in colors to respective portions of a picture to be displayed, graphic forms corresponding to the colors are written by software into picture RAMs corresponding to the colors, taking into account the overlap of the graphic forms, and the outputs of the picture RAMs are combined to obtain video signals. For example, in the case where areas 1, 2 and 3 of a graphic form consisting of three overlapping circles are to be displayed in red, green and blue, respectively, as shown in FIG. 1A, a graphic form 5 of the area 1 to be colored in red, a graphic form 7 of the area 2 to be colored in green and a graphic form 9 of the area 3 to be colored in blue are written by software processing into red, green and blue picture RAMs 4, 6 and 8, respectively, as shown in FIGS. 1B to D.

For obtaining such graphic forms as shown in FIGS. 1B to D by finding their intersecting points through software processing, however, a lot of processing is needed, resulting in too much work being imposed on a microprocessor. Especially, when the graphic forms change their positions with time relative to one another, arithmetic processing must be executed for obtaining their intersecting points for each change, so that much time is consumed for the arithmetic processing, making it difficult, in practice, to provide such a colored graphic display.

SUMMARY OF THE INVENTION

It is therefore an object of the present invention to provide a color display unit which allows ease in providing a colored graphic display.

Another object of the present invention is to provide a color display unit which is capable of putting in colors to a plurality of graphic forms, as desired, even if they are overlapping.

Yet another object of the present invention is to provide a color display unit which is capable of putting in colors to a plurality of graphic forms by hardware processing, as desired, even if they are overlapping and moving relative to one another.

Briefly stated, the color display unit of the present invention is provided with a plurality of picture RAMs, write means for writing graphic form information into the picture RAMs priority level specifying means for specifying the priority levels of the outputs of the picture RAMs, a CRT controller for synchronously accessing the picture RAMs, a priority circuit for outputting the outputs of the picture RAMs in accordance with their priority levels specified by the priority specifying means, and a color display supplied with the output of the priority circuit to display graphic forms in colors determined by a combination of the picture RAMs.

In accordance with the present invention, graphic forms are produced by software without taking their overlap into account and stored in picture RAMs corresponding to colors, respectively, and priorities are given to the picture RAMs so that when their outputs are combined, the overlapping graphic forms may be displayed in desired colors. For instance, in the case of displaying such a graphic form of the indicated colors as shown in FIG. 1A, circular graphic forms are stored in red, green and blue picture RAMs 21, 22 and 23, respectively, without taking into consideration the overlapping of the graphic forms as shown in FIGS. 2A to C, and priorities are given to the red, green and blue colors in this order. When the RAM outputs are combined, the green and blue outputs are inhibited by the red output and the blue output is inhibited by the green output, thereby displaying the picture of FIG. 1A.

Further, the display unit of the present invention is provided with a feedback circuit for feeding the output of the priority circuit back to the picture RAMs and data update control means for specifying which one of the picture RAMs is to be rewritten with the output of the feedback circuit. The content of a display is modified by hardware processing.

BRIEF DESCRIPTION OF THE DRAWINGS

FIG. 5 is a table showing, by way of example, the relationship between the output of a priority select circuit and the selecting operation of the priority circuit;

DESCRIPTION OF THE PREFERRED EMBODIMENTS

Figure 1:
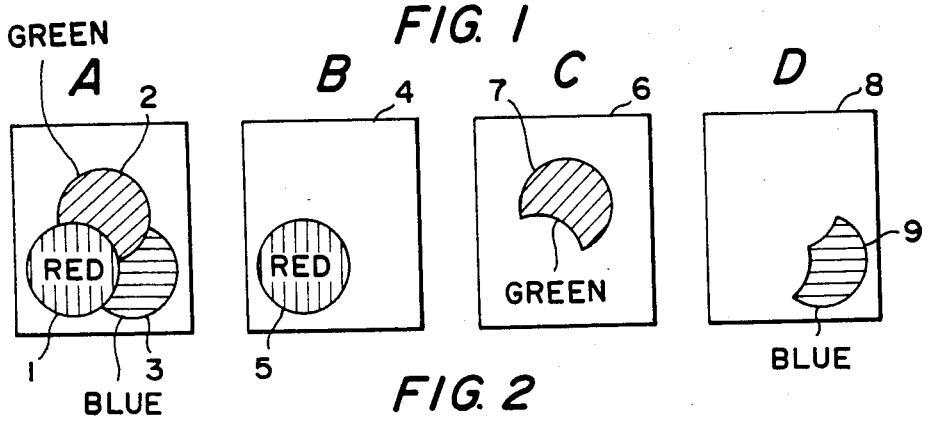
FIGS. 1A to D show a series of disgrams explanatory of the operation of a conventional color display unit.
Figure 2:
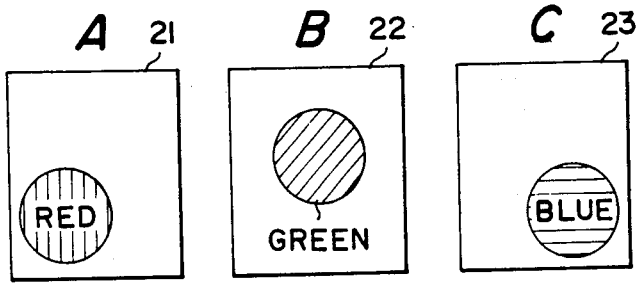
FIGS. 2A to C show a series of diagrams explanatory of the principle of the present invention.
Figure 3B:
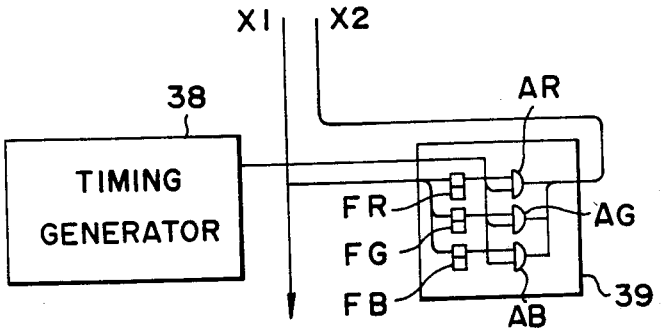
FIGS. 3A and B are block diagrams illustrating an example of the hardware configuration of the color display unit of the present invention.
Figure 3A:
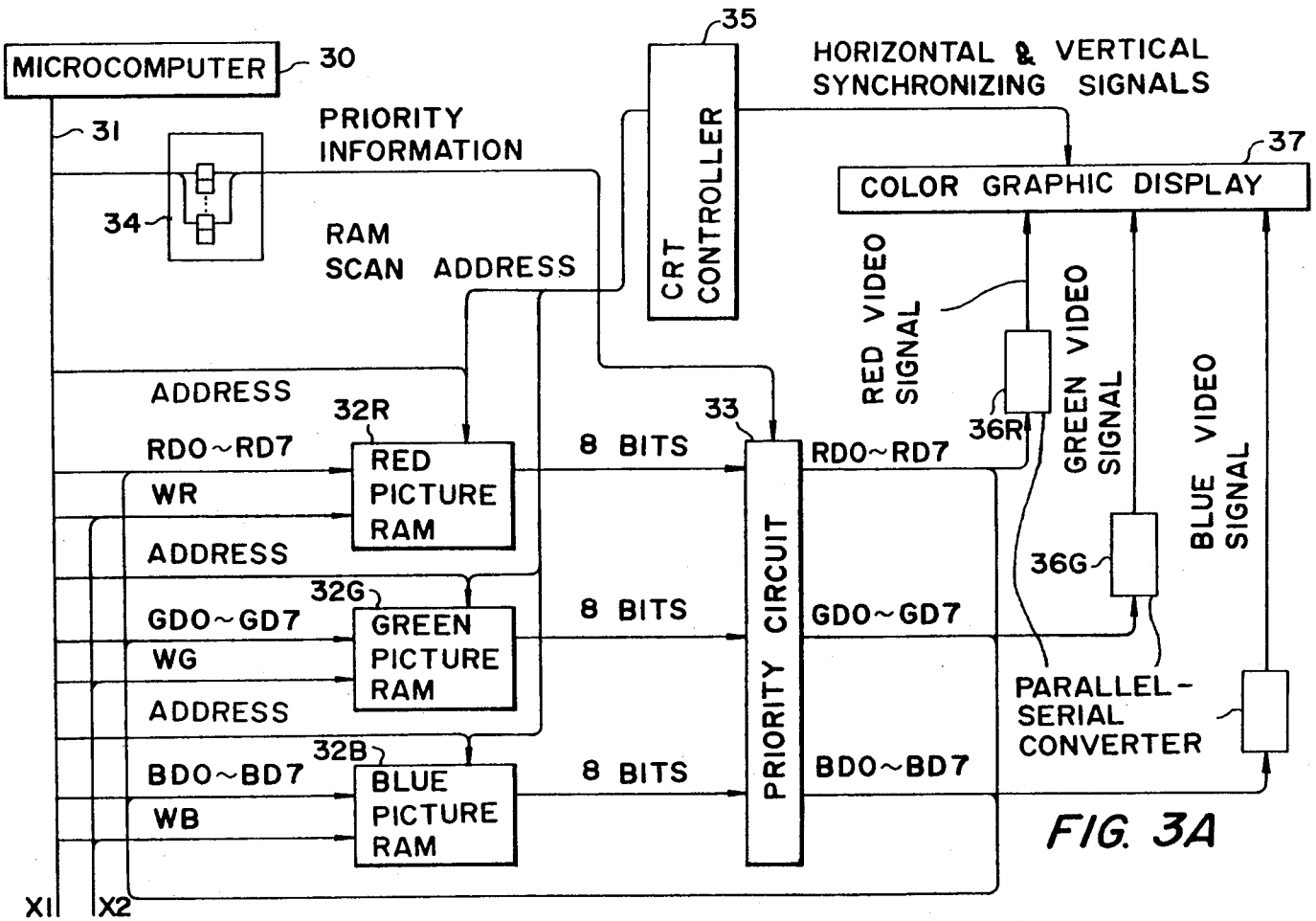

In FIGS. 3A and B, reference numeral 30 indicates a microcomputer; 31 designates its bus; 32R, 32G and 32B identify a red picture RAM, a green picture RAM and a blue picture RAM, respectively; 33 denotes a priority circuit; 34 represents a priority select circuit; 35 shows a CRT controller; 36R, 36G and 36B refer to parallel-serial converters; 37 signifies a color graphic display; 38 indicates a timing generator; and 39 designates a data update control circuit.

The red, green and blue picture RAMs 32R, 32G and 32B are writable/readable memories for storing respective red-colored, green-colored and blue-colored graphic form information to be displayed on the screen of the color graphic display 37, respectively. Data is written into these memories from the microcomputer 30 and, further, through utilization of the output of the priority circuit 33. Moreover, the picture RAMs can each be accessed from the microcomputer 1 to read out its content at a desired address and, by the address output of the CRT controller 35, they are accessed in synchronism with one another to scan their contents with a fixed period. The scanned outputs are provided to the priority circuit 33.

The priority circuit 33 processes the outputs of the thus synchronously accessed RAMs 32R, 32G and 32B in the order of their specified priorities, and provides the output of the RAM with the highest priority to the corresponding parallel-serial converters 36R, 36G and 36B. The priority levels of the RAMs 32R, 32G and 32B are specified by the outputs R1, R0, G1, G0, B1 and B0 of the priority select circuit 34 which is provided with six-bit latches into which data can be written from the microcomputer 30.

Figure 4:
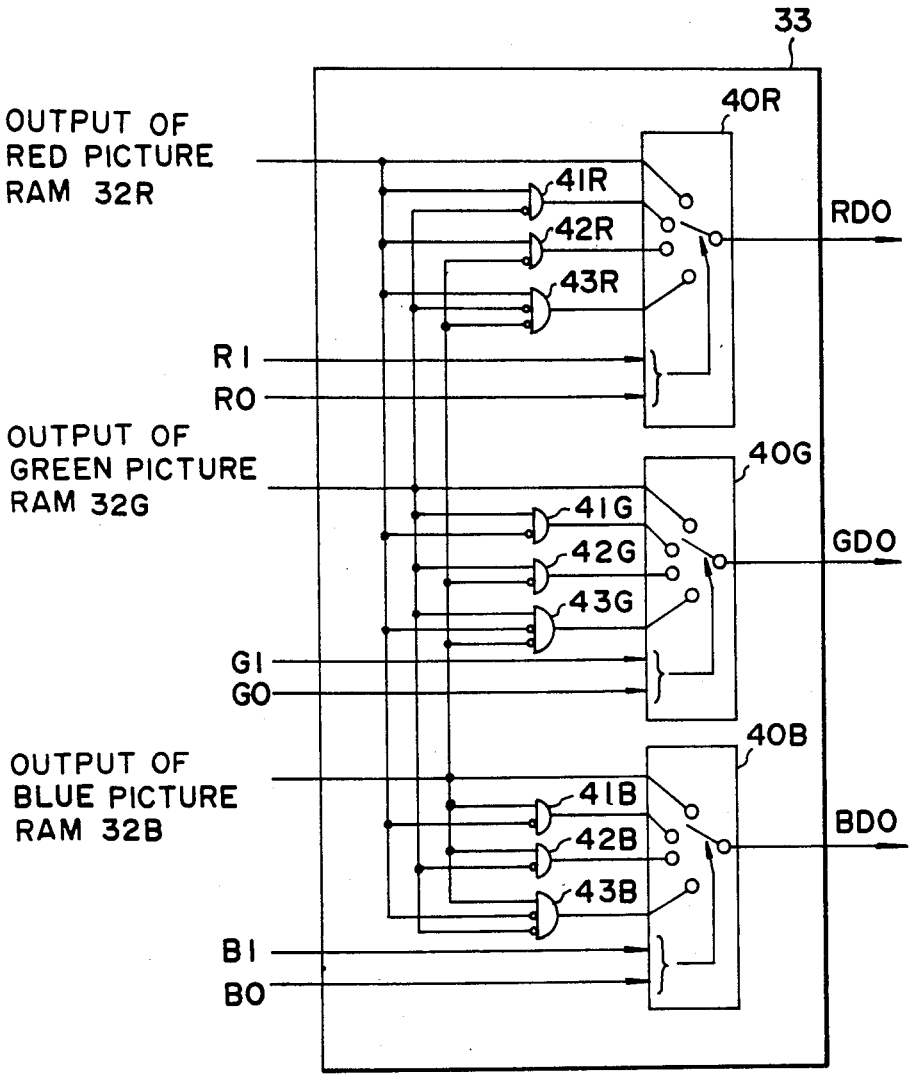
FIG. 4 is a block diagram illustrating a specific example of a priority circuit used in the present invention.

FIG. 4 is a block diagram of a specific example of the priority circuit 33, illustrating only a processing circuit of one bit of an eight-bit parallel output of each of the picture RAMs 32R, 32G and 32B. The one bit output of each picture RAM is input via four lines into all of the multiplexers 40R, 40G and 40B, and any one of the four inputs is selected by all of the outputs R1 and R0, G1 and G0, or B1 and B0 of the priority select circuit 34. Data circuits 41R to 43R, 41G to 43G and 41B to 43B are each a gate circuit with an inhibit input. FIG. 5 shows an example of the relation between the output of the priority select circuit 34 and the selecting operation of the priority circuit 33. It is predetermined that the priority level A is the highest one and priority C the lowest one. For instance, when the outputs (R1, R0, G1, G0, B1, B0) of the priority select circuit 34 are (000000), the outputs of the three RAMs 32R, 32G and 32B are all applied to the parallel-serial converters 36R, 36G and 36B, respectively, since there is no difference in priority among them. In this case, if the red, green and blue picture RAMs 32R, 32G and 32B have stored therein at the same address the information to be displayed, then the corresponding portion of the picture displayed is colored in white. When the outputs (R1, R0, G1, G0, B1, B0) are (000111), the outputs of the green and blue picture RAMs 32G and 32B are masked by the output of the red picture RAM 32R, and the output of the blue picture RAM 32B is masked by the output of the green picture RAM 32G. Incidentally, a total of four bits is sufficient for specifying the priority levels, but the present example employs six bits for the purpose of simplifying the arrangement of the priority circuit 33.

In FIGS. 3A and B, the parallel-serial converters 36R, 36G and 36B convert eight-bit parallel outputs RD0 to RD7, GD0 to GD7 and BD0 to BD7 of the picture RAMs 32R, 32G and 32B into serial data, which are provided as red, green and blue video signals to the color graphic display 37. The color display 37, as well-known in the art, determines phase differences among chrominance signals according to a combination of the red, green and blue video signals, thus obtaining a total of eight colors. Horizontal and vertical synchronizing signals of the color display 37 are generated by the CRT controller 35.

The outputs of the priority circuit 33 are fed back to the inputs of the red, green and blue picture RAMs 32R, 32G and 32B, and their contents selected by the output of the data update control circuit 39 can be rewritten by the outputs of the priority circuit 33. The data update control circuit 39 comprises flip-flops FR, FG and FB for red, green and blue colors, respectively, which can be set and reset by the microcomputer 30, and AND circuits AR, AG and AB for ANDing the outputs of the flip-flops FR, FG and GB and a write signal from the timing generator 38. Outputs WR, WG and WB of the AND circuits AR, AG and AB are input as write signals into the red, green and blue picture RAMs 32R, 32G and 32B.

Figure 6:
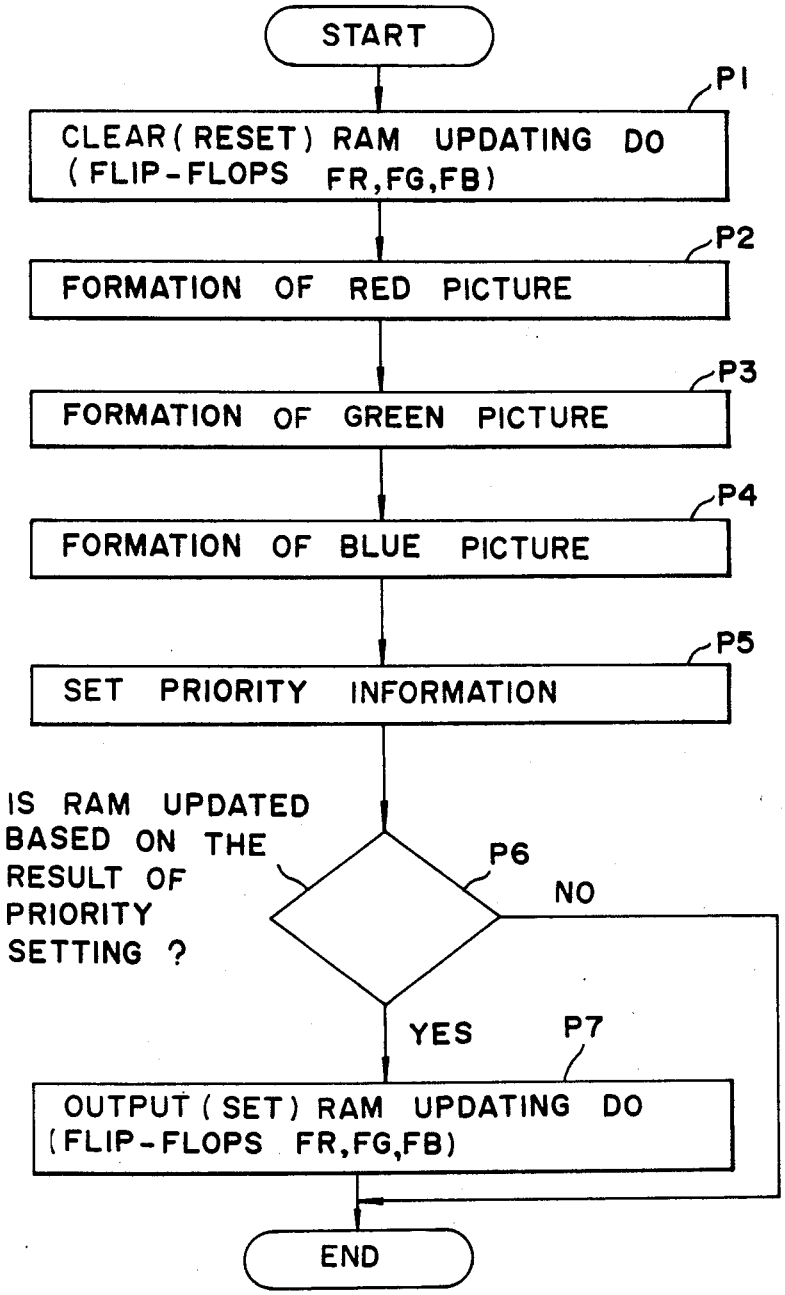
FIG. 6 is a flowchart showing an example of the software configuration for implementing the color display function of the color display unit of the present invention.
Figure 7:
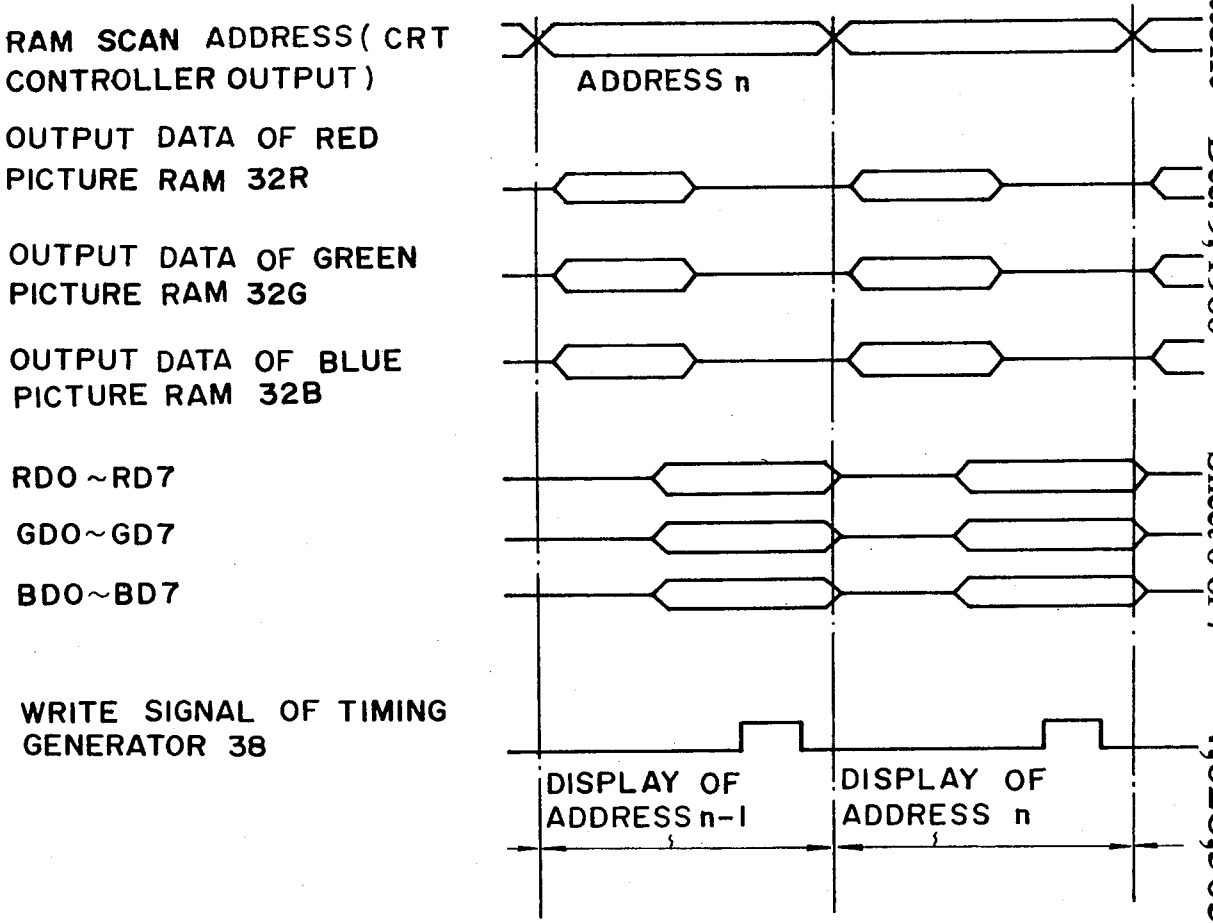
FIG. 7 is a timing chart showing, by way of example, signal waveforms occurring at respective parts of the unit shown in FIGS. 3A and B.

FIG. 6 is a flowchart showing an example of the software configuration which implements the color display function of the color display unit of the present invention. FIG. 7 is a timing chart showing, by way of example, signal waveforms occurring at respective parts of the unit depicted in FIG. 3. A description will be given, with reference to FIGS. 6 and 7, of the operation of the unit shown in FIGS. 3A and B.

At first, the microcomputer 30 resets all the flip-flops FR, FG and FB of the data update control circuit 39 (step P1), and then it writes via the bus 31 into the red, green and blue picture RAMs 32R, 32G and 32B respective information of red-colored, green-colored and blue-colored graphic forms to be displayed (steps P2 to P4). In this case, any overlapping of the graphic forms need not be taken into consideration. For example, as shown in FIG. 8A, in the case of displaying the cutting of a workpiece 80 with a cutter 81, when the workpiece 80 is displayed in red, the cutter 81 in green and the background in blue, such a graphic form of the workpiece 80 as shown in FIG. 8B is written into the red picture RAM 32R, such a graphic form of the cutter 81 as shown in FIG. 8C is written into the green picture RAM 32G and a graphic form the entire area of which is blue as shown in FIG. 8D is written into the blue picture RAM 32B.

Next, the microcomputer 30 sets in the priority select circuit 34, as its outputs (R1, R0, G1, G0, B1, B0), such a data as (010011) that gives priorities to the pictures in the order green-red-blue (step P5). Thus the priority circuit 33 processes, in accordance with the priorities, the outputs of the red, green and blue picture RAMs 32R, 32G and 32B which are read out in synchronism with one another. As a result of this, the graphic forms and the colors of the contents shown in FIG. 8A are displayed on the screen of the color graphic display 37.

When the necessity of updating the content of the RAM arises from the priority setting, the microcomputer 30 sets that one of the flip-flops of the data update control circuit 39 which corresponds to the RAM that must be updated (steps P6 and P7). In this example, since the workpiece 80 is cut by the cutter 81, only the red picture RAM 32R has to be updated and, consequently, the flip-flop FR is set and the other flip-flops FG and FB are reset.

Figure 8:
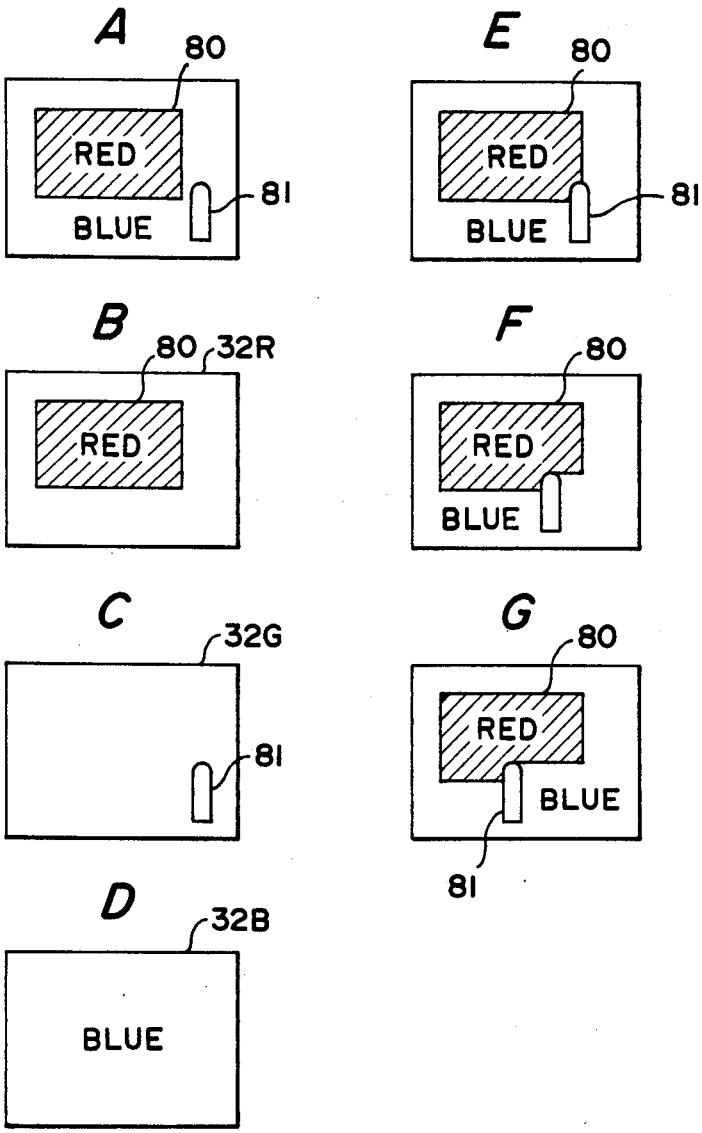
FIGS. 8A to G show a series of diagrams explanatory of the operation of the color display unit of the present invention.

As the graphic form of the cutter 81 is moved in the cutting direction while sequentially rewriting the content of the green picture RAM 32G by the microcomputer 30 in a known manner, the picture being displayed undergoes such changes as shown in FIGS. 8E, F and G. That is, as shown in the timing chart of FIG. 7, by the write signal which is yielded in synchronism with the outputs RD0 to RD7, GD0 to GD7 and BD0 to BD7 of the priority circuit 33, the content of the red picture RAM 32R alone is rewritten with the outputs RD0 to RD7 of the priority circuit 33 corresponding to the red color, so that the portion of the workpiece that has been cut is not displayed but instead the blue-colored background is displayed.

While in the above example the three picture RAMs 32R, 32G and 32B are made to correspond to red, green and blue in advance and the priority levels are given to these colors, the correspondence between the colors and the picture RAMs is freely settable and two or more than three RAMs can also be employed. Further, the present invention is applicable not only to the graphic display but also to the character display.

As has been described in the foregoing, according to the present invention, priority levels are set for a plurality of picture RAMs and that one of the synchronously read out RAM outputs that has a higher priority is taken out by a priority circuit for input into a display, so that even if overlapping graphic forms are to be displayed, the overlap need not be taken into account and it is sufficient only to set the priority levels. This allows ease in the formation of a graph and permits the reduction of the time required therefor.

Moreover, since the contents of the picture RAMs can be modified with the output of the priority circuit, a graphic display can easily be provided which has been substantially impossible because conventional software processing therefor has taken too much time.

It will be apparent that many modifications and variations may be effected without departing from the scope of the novel concepts of the present invention.

What is claimed is:

1. A color display unit comprising:

a plurality of picture RAMS, each having memory locations corresponding to display points of a display, and each said picture RAM corresponding to a predetermined color;

write means for writing respective graphic form information into the plurality of picutre RAMs;

priority specifying means for setting therein respective predetermined priority levels of the outputs of the plurality of picture RAMs;

a CRT controller for accessing the plurality of picture RAMs in synchronism with one another;

a priority circuit for respectively outputting in accordance with the priority levels specified by the priority specifying means, the outputs of the plurality of picture RAMs accessed by the CRT controller; and a color dispaly means for providing said display with said display points, said color display means being supplied with the output of the priority circuits, for displaying graphic forms determined by the combination of the graphic form information in said plurality of picture RAMs and said priority levels, in colors also determined by said combination.

2. A color display unit according to claim 1, further comprising a feedback circuit for feeding said outputs of the priority circuit respectively back to the plurality of picture RAMs, and data update control means for respectively specifying each of the plurality of picture RAMs which is to be rewritten with the respective output of the feedback circuit.

3. The unit of claim 2, wherein respective ones of said colors result from the respective graphic form information in a plurality of said picture RAMs being simultaneously provided at a respective plurality of the outputs of said priority circuit according to said priority levels.

4. The unit of claim 2, wherein the rewriting of said picture RAMs occurs simultaneously with a respective display.

5. The unit of claim 2, wherein said write means rewrites said graphic form information in a selected one of said pciture RAMs, while corresponding respective graphic form information in each other of said picture RAMs is correspondingly updated according to the rewriting and said priority levels.

6. The unit of claim 5, wherein said updating constitutes changing said graphic form information in each said picture RAM being updated to correspond to the current display of the respective picture RAM color.

7. The unit of claim 2, comprising further means for controlling when each of said RAMs is to be updated by the respective output of said priority circuit.

8. The unit of claim 3, comprising further means for controlling when each of said RAMs is to be updated by the respective output of said priority circuit.

9. The unit of claim 4, comprising further means for controlling when each of said RAMs is to be updated by the respective output of said priority circuit.

10. The unit of claim 5, comprising further means for controlling when each of said RAMs is to be updated by the respective output of said priority circuit.

11. The unit of claim 6, comprising further means for controlling when each of said RAMs is to be updated by the respective output of said priority circuit.

12. The unit of claim 1, wherein said priority levels of said RAM can be selectively set to be equal or different from each other.

* * * * *